US005494252A

United States Patent [19]

Amit et al.

[11] Patent Number: 5,494,252

[45] Date of Patent: Feb. 27, 1996

[54] DEVICE AND METHOD FOR EFFECTING RELATIVE MOTION WITHIN A CLOSED SALES DISPLAY PACKAGE

[75] Inventors: Noah Amit, New York, N.Y.; Omri Mairon, Kibbutz Ruhama, Israel

[73] Assignees: Biobright Corporation, Palm Beach, Fla.; Bio Bright Industries, Ltd., Kibbutz Ruhama, Israel

[21] Appl. No.: 340,844

[22] Filed: Nov. 17, 1994

Related U.S. Application Data

[63] Continuation of Ser. No. 291,881, Aug. 17, 1994, abandoned.

[51] Int. Cl.[6] ..... F16M 13/00

[52] U.S. Cl. ..... 248/560; 206/362.2

[58] Field of Search ..... 248/560, 613, 248/620, 685; 206/362.1, 362.2, 362.3, 478

[56] References Cited

U.S. PATENT DOCUMENTS

| | | | |
|---|---|---|---|
| 380,080 | 3/1888 | Bouton et al. | 206/362.2 X |
| 3,574,879 | 4/1971 | Werding | 206/362.2 X |
| 5,120,225 | 6/1992 | Amit | 433/216 |
| 5,186,627 | 2/1993 | Amit et al. | 433/216 |

*Primary Examiner*—Ramon O. Ramirez

*Attorney, Agent, or Firm*—Cowan, Liebowitz & Latman; Morey B. Wildes

[57] ABSTRACT

A device for effecting relative motion of movable components of a product within a closed sales display package translates a force exerted in one direction so that the force is applied in a second direction through buckling of a motion spring. The motion spring is two-dimensional, i.e., flat, and is oriented so that its flat surfaces face the direction of motion and so that its top and bottom edges are secured to opposite sides of a sales package. Pressure that is exerted vertically on the top and bottom edges of the spring causes the spring to buckle about a horizontal axis, thereby deflecting the flat surface of the spring in a horizontal direction that is perpendicular to both the vertical direction of force and the horizontal buckling axis. The motion spring is secured at its top and bottom vertical edges to the front and back, respectively, of the sales package. When the spring is to be used in conjunction with the rotatable toothbrush of U.S. Pat. Nos. 5,120,225 and 5,186,627, the spring is secured to the toothbrush by supporting the toothbrush handle around its periphery. Exerting force vertically on the spring through the sales package creates buckling and deflection of the area of the spring secured to the toothbrush handle, thereby moving the handle in the direction of deflection of the spring, which is longitudinally with the respect to the toothbrush handle. Release of the vertical force will allow the motion spring to relax so that the toothbrush handle can be returned longitudinally to its original position.

46 Claims, 4 Drawing Sheets

DEVICE AND METHOD FOR EFFECTING RELATIVE MOTION WITHIN A CLOSED SALES DISPLAY PACKAGE

CROSS-REFERENCE TO RELATED APPLICATION

This application is a continuation of U.S. patent application Ser. No. 08/291,881, filed Aug. 17, 1994, now abandoned entitled DEVICE AND METHOD FOR EFFECTING RELATIVE MOTION WITHIN A CLOSED SALES DISPLAY PACKAGE.

BACKGROUND OF THE INVENTION

The present invention relates to sales packaging for consumer products that involve relative motion of one or more of their component parts. More particularly, this invention relates to a device and a method for effecting relative motion of a component part of a consumer product within a closed sales display package. Still more particularly, this invention relates to a device and a method for demonstrably effecting longitudinal motion of the handle of a toothbrush relative to the head of a toothbrush having rotatable bristles for the purpose of rotating the bristles in view of a consumer, while the toothbrush is encased within a sealed sales display package.

It is common in the retail business, particularly in the toy and consumer products industries, to display saleable products such that the actual operation of the products can be demonstrated to the consumer. In this way, because the consumer is able to actually operate the product or toy prior to purchase, purchaser awareness and satisfaction are increased. However, due to the fragility of complex consumer products, frequent handling and trial usage by consumers often leads to damage or deterioration of display products. Also, open display of unpackaged products increases the risk of shoplifting of the consumer products that are on display. Therefore, many retailers are loathe to display unpackaged or unsecured products.

Retailers often instead prefer to display products within closed sales display packages in order to avoid deterioration and breakage of the products due to rough trial usage and in order to avoid theft and shoplifting of the loose products. Unfortunately, display of a product within a closed sales display package often does not allow relative motion of the components of that product to be demonstrated to the consumer.

One type of consumer product or toy that may be operable from outside a closed sales display package is one that is electrically operated. Operating the product from outside the closed sales package is often accomplished by situating an electrical contact or an activation button on the surface of the device adjacent the deformable packaging. When the item is packaged within a closed sales display package, the deformable packaging is situated such that an interested consumer can operate the device by pressing the activation button through the deformable display package and completing a circuit.

An example of an electrically-operated toy that is operable by pressing an activation button through the display package is described in U.S. Pat. No. 4,925,025. This type of toy typically involves a tiny bulb that is lit up or involves some other activation device with electrical components. Unfortunately, however, electrically operated toys often do not possess the type of visibly movable component parts that allow a consumer to actually see the operation of the device, and the consumer thus does not get the satisfaction of watching the components move.

Other types of consumer products or toys that may be operated from outside a closed sales display package are mechanical products that utilize a means for activating the product, which means extends partially outside the package. For example, talking toys are operable by way of a pull string that extends outside of the otherwise-closed sales display package allowing a consumer to demonstrate the speech mechanisms of the toy without opening the sales display package. Similarly, a sales display package that includes a pivoted lever assembly having one portion extending outside the package and another portion inside the package enables a consumer to activate a switch within the package by actuating the exterior lever portion, causing the interior lever portion to activate the switch and thereby operate the device. An example of an external lever-operated device is shown in U.S. Pat. No. 5,188,222. Again, however, the movable components of the products displayed in these packages are situated within the product and their movements are not visible to a consumer. Thus, pulling a pull string or activating a switch through a lever will not give the consumer the satisfaction of watching the components move. Moreover, because these actuation devices extend partially outside the display packages, the packages must be open in some manner, leaving them more susceptible to shoplifting, breakage or deterioration from moisture.

Various mechanical consumer products that have visibly, mechanically movable components are sold in closed sales display packages. For example, U.S. Pat. Nos. 5,120,225 and 5,186,627 disclose a hand-actuated toothbrush with rotatable bristles, in which a group of bristles mounted within the toothbrush head is connected to a movable handle by way of a rack and pinion within the base of the head, such that longitudinal reciprocation of the handle causes the group of bristles to be rotated in response. Unfortunately, consumers have no way of viewing the mechanical motion of the component parts of the rotatable toothbrush or of other consumer products while the products are within the closed sales display packages because there is no mechanism or device for visibly demonstrating to a consumer the mechanical motion of components of a device that is within a closed sales display package.

It is, therefore, an object of this invention to provide a device and a method for visibly effecting relative motion of movable components of a consumer product encapsulated within a sealed sales display package.

It is another object of this invention to provide a device that visibly effects linear motion of an elongated object that is encapsulated within a closed sales display package.

It is a further object of this invention to provide a device that visibly effects the longitudinal motion of the handle of the hand-activated rotatable toothbrush disclosed in U.S. Pat. Nos. 5,120,225 and 5,186,627 such that the rotatable group of bristles rotates in response, while the toothbrush is encapsulated within a closed sales display package.

These and other objects of the invention will become more apparent in the discussion below.

SUMMARY OF THE INVENTION

The above objects of the invention are accomplished by providing a "motion spring" that translates a force exerted in one direction so that the force is applied in a second direction through buckling of the motion spring. The motion spring is two-dimensional, i.e., flat, and is oriented so that its flat surfaces face the direction of motion. Pressure that is exerted vertically on the top and bottom edges of the spring causes the spring to buckle about a horizontal axis, thereby deflecting the flat surface of the spring in a horizontal direction that is perpendicular to both the vertical direction of force and the horizontal buckling axis.

The motion spring is secured at its top and bottom vertical edges to the front and back, respectively, of the sales package. When the spring is to be used in conjunction with the rotatable toothbrush of U.S. Pat. Nos. 5,120,225 and 5,186,627, the spring is secured to the toothbrush by supporting the toothbrush handle around its periphery. Exerting force vertically on the spring through the sales package creates buckling and deflection of the area of the spring secured to the toothbrush handle, thereby moving the handle in the direction of deflection of the spring, which direction is longitudinal with the respect to the toothbrush handle. Release of the vertical force will allow the motion spring to relax so that the toothbrush handle can be returned longitudinally to its original position.

BRIEF DESCRIPTION OF THE DRAWINGS

The above and other objects and advantages of the invention will be apparent upon consideration of the following detailed description, in which the reference characters refer to like parts throughout and in which.

DETAILED DESCRIPTION OF THE INVENTION

Figure 1:
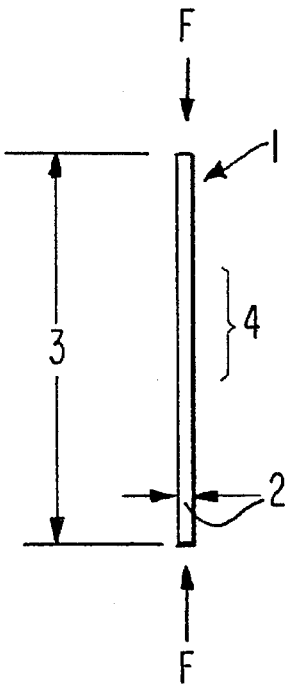
FIG. 1 shows a left side elevational view of the device of the present invention in its relaxed position.
Figure 2:
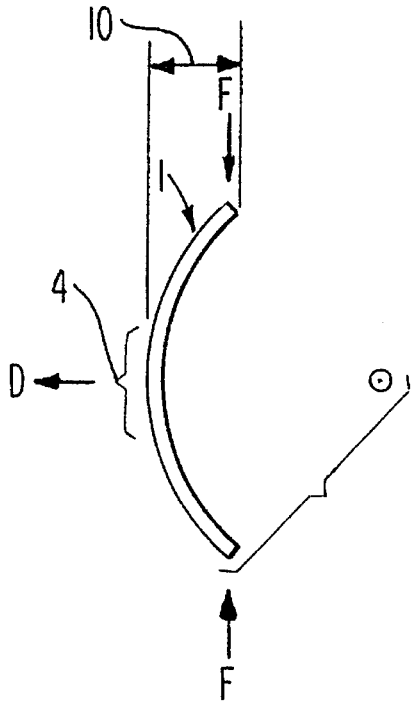
FIG. 2 shows a left side elevational view of the device of the present invention in its flexed position.

The device for effecting relative motion of component parts of a product within a closed sales display package consists of a thin, flat, planar motion spring 1, as shown in FIGS. 1 and 2. The device of this invention is made of plastic, metal or some other springy, resilient material. The device 1 is fashioned so that its thickness 2 is small compared to its height 3 and width (not shown), and so that its height 3 is greater (at most regions) than its width. When a force F is exerted vertically on the top and bottom edges of the upright motion spring, as shown in FIG. 1, the motion spring 1 is caused to buckle into an arched shape, as shown in FIG. 2. Because the height of the motion spring is greater than its width, the motion spring is fashioned so that buckling will occur only in one direction, i.e., about a horizontal axis H parallel to the plane of the motion spring 1. Deflection 10 of the motion spring will occur at the middle portion 4 of the motion spring 1 and in a horizontal direction D perpendicular to the horizontal buckling axis H (which is parallel to the plane of the motion spring) and to the vertical direction of force F.

In order to assure proper buckling of the motion spring and deflection in the desired direction, the spring could be given a very slight initial arched shape in the desired direction of buckling. This initial predisposed shape will ensure that the motion spring will buckle in the arched direction. However, the total movement of the middle portion of the motion spring will be less than the maximum possible deflection because the motion spring is already partially deflected in the desired direction. Thus, although buckling in the desired direction is ensured, deflection of the motion spring and movement of the moveable component parts of the displayed product is not maximized.

Figure 3:
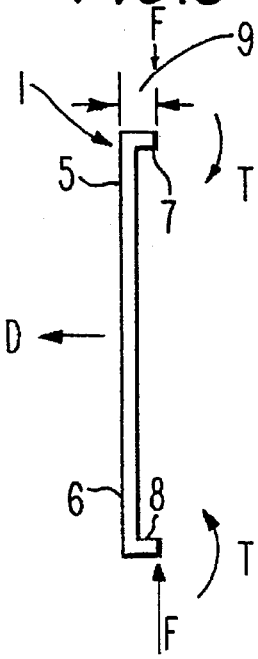
FIG. 3 shows a left side elevational view of a preferred embodiment of the device of the present invention in its relaxed position.

An alternative way of assuring buckling of the motion spring and deflection in the desired direction without predisposing the flat motion spring to a particular shape, as illustrated in FIG. 3, is by forming the top and bottom edges 5,6 of the motion spring 1 into widened "feet" 7,8. The feet can be formed by bending, molding or otherwise forming the top and bottom edges 5,6 of the motion spring 1 such that a portion of each edge extends a short distance 9, or depth, in a direction somewhat perpendicular to the plane of the motion spring. The depth 9 of the feet 7,8 allows a greater area on the motion spring top and bottom edges 5,6 to which a force F may be exerted. Application of the force F at a distance, however small, from the plane of the motion spring creates a torque T or moment about the edges 5,6 of the motion spring 1 about the horizontal axis H in the direction D opposite to that in which the feet extend, thereby causing buckling to occur only in that direction D. The feet thus create a natural resistance of the motion spring, at the junction of the edges 5,6 of the motion spring 1 and the feet 7,8, to bend further in the direction of the feet, and the motion spring is almost forced to buckle in the direction D opposite to that in which the feet extend.

Figure 4:
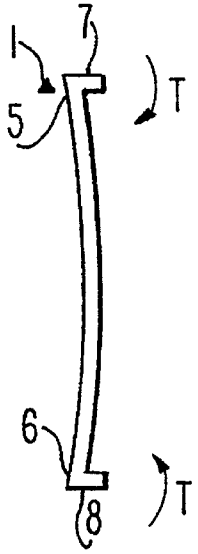
FIG. 4 shows a left side elevational view of a further preferred embodiment of the device of the present invention in its relaxed position.

In the presence of "footed" edges of the motion spring, movement of the middle portion of the motion spring can be increased even beyond the normal maximum deflection because the directed buckling in the direction away from the feet occurs even for a spring with an oppositely predisposed initial arch. This is shown in FIG. 4. The torque T created about the edges 5,6 of the motion spring 1 due to the presence of the feet 7,8 will tend to cause buckling in the direction D away from the feet 7,8 even when the motion spring 1 has an initial arched shape in the opposite direction, that is in the direction of the feet. Thus, in a preferred embodiment, a motion spring 1 with an oppositely predisposed initial arch can be used with widened feet 7,8 at its edges 5,6. This embodiment enables a greater deflection of the motion spring to be achieved in the desired direction, as the middle portion of the motion spring must first deflect the distance of the predisposed arch and only then deflect its normal distance.

In order for the motion spring device to effect the movement of component parts of a product within a closed sales display package, the motion spring must be abutting or secured to a movable part of the product so as to cause the movement. Preferably, the portion of the motion spring that is abutting or secured to the product is the middle portion of the motion spring, i.e., the portion that deflects the most in the horizontal direction. The movable component of the packaged product should somehow be abutting or connected to the middle portion of the motion spring so that buckling and relaxing of the spring will cause back and forth motion of this portion and of the product connected thereto. Also, the top and bottom edges of the motion spring must be secured or connected to the inside of the sales display package at opposite sides of the package so that a consumer can exert pressure against the outside of the sales display package adjacent the top and bottom edges of the motion spring. This pressure by a consumer applies a force to the top and bottom edges of the motion spring, thereby deforming the motion spring and causing movement of the movable component part of the product abutting the motion spring or secured thereto. These connections can be by any means, such as friction, adhesive or other means.

Figure 5:
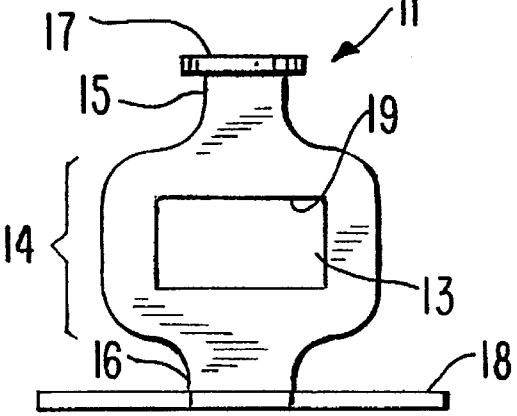
FIG. 5 shows a front elevational view of a preferred embodiment of the device of the present invention to be used with the rotatable toothbrush of U.S. Pat. Nos. 5,120,225 and 5,186,627.

In a preferred embodiment of this invention for use with the rotatable toothbrush of U.S. Pat. Nos. 5,120,225 and 5,186,627 ("the patented toothbrush"), as shown in FIG. 5, the middle portion 14 of the motion spring 11 is widened and a rectangular hole 13 is formed therethrough in order to allow the motion spring 11 to be attached to the handle of the rotatable toothbrush. The handle of the patented toothbrush has several ridges oriented transversely across the top of the handle normally used for gripping by the consumer during use. The handle is inserted through the rectangular hole 13, and the motion spring 11 is secured to the handle by snapping the downward-facing top edge 19 of the rectangular hole 13 between two of the transverse ridges on the top of the handle. In a further preferred embodiment, the area of the rectangular hole 13 is substantially equal to the cross-sectional area of the toothbrush handle so that the handle fits snugly within the hole 13.

The motion spring must also be secured within the display package so that only the product components, and not the top and bottom edges of the motion spring, move. For this purpose, the motion spring has upper and lower support struts 17,18 that are respectively mounted within upper and lower support sockets of the display package. As shown in FIG. 5, these support struts 17,18, which can simply be widened extensions of the top and bottom edges 15,16 of the motion spring 11, are used to securely hold the top and bottom edges 15,16 of the motion spring 11 in place within the front and back of the display package, respectively. The support struts can, in a preferred embodiment, be in the form of shaped feet described above in order to assist in the buckling of the motion spring, in addition to securely holding the edges of the motion spring within the display package.

Figure 6:
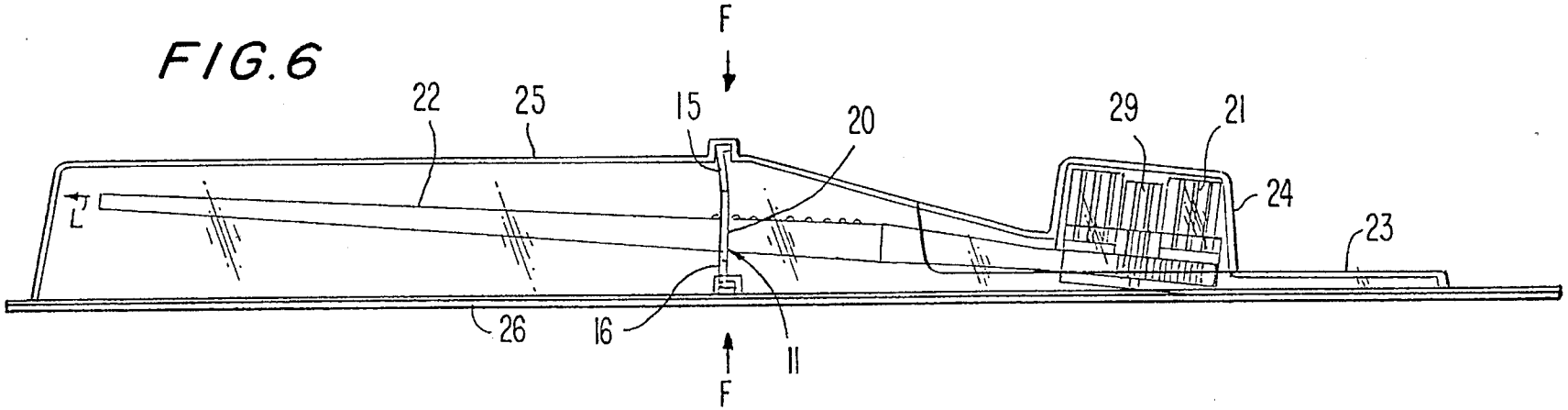
FIG. 6 shows a left side elevational view of a preferred embodiment of the device of the present invention in its relaxed position in use with the rotatable toothbrush of U.S. Pat. Nos. 5,120,225 and 5,186,627.
Figure 7:
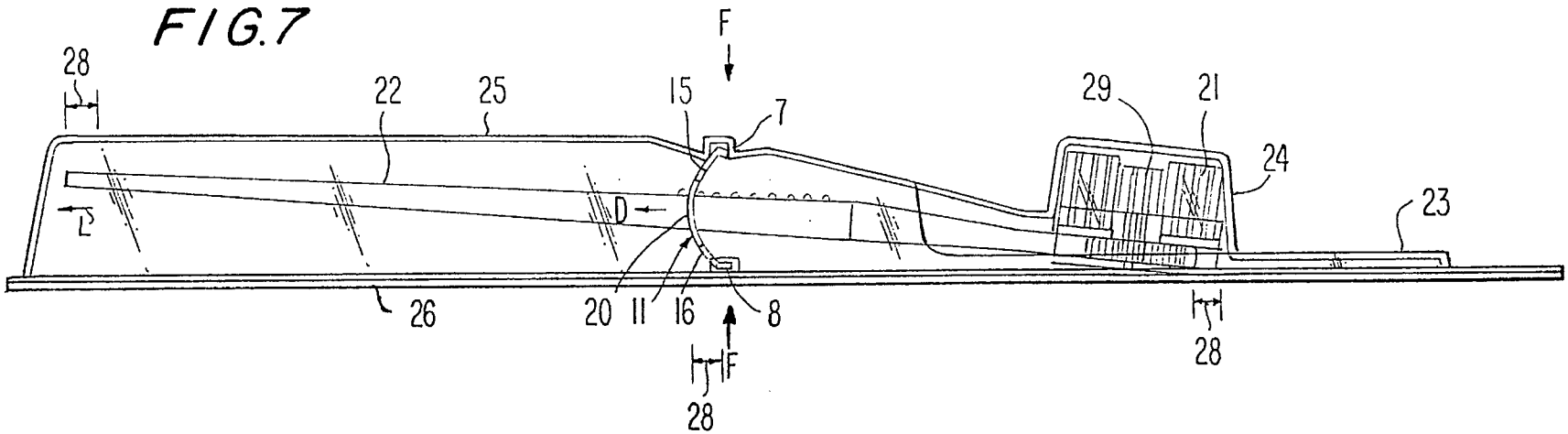
FIG. 7 shows a left side elevational view of a preferred embodiment of the device of the present invention in its flexed position in use with the rotatable toothbrush of U.S. Pat. Nos. 5,120,225 and 5,186,627.

The method of operation of this invention within a package containing the patented toothbrush is shown in FIGS. 6 and 7. The movable toothbrush head 21 is securely located within a chamber 24 at the front end of the display package 23 such that any movement of the toothbrush head 21 while the toothbrush handle 22 is moved longitudinally within the sales package 23 is prevented. When a consumer presses on the transparent packaging cover on the front 25 of the sales package 23 and on the back cover 26 of the sales package 23, the consumer exerts a force F on the front 25 and back 26 of the sales package 23 containing the patented toothbrush, thereby exerting respective forces F on the top edge 15 and bottom edge 16 of the motion spring 11 secured thereto. The exerted forces F cause the motion spring 11 to buckle, as described above, resulting in a deflection 28 in the direction D of the middle portion 20 of the motion spring 11 attached to the handle 22 of the patented toothbrush, also described above. The deflection 28 of the middle portion 20 of the motion spring 11 moves the handle 22 of the patented toothbrush with respect to the stationary toothbrush head 21 in a longitudinal direction L that is substantially parallel to the direction D of deflection 28 of the motion spring 11. This relative longitudinal movement 28 actuates the rotation of the group of bristles 29 in the toothbrush head 21. Because the patented toothbrush is encased within a transparent sales display package 25, this activity all occurs within full view of the consumer who initially exerted the force F on the package 23.

In an alternative embodiment of this invention for use with the patented toothbrush, the longitudinal motion of the toothbrush handle and the rotation of the toothbrush bristles can be increased by using a motion spring having an oppositely predisposed initial arch. In this structure, as discussed earlier, the deflection of the middle portion of the motion spring, and therefore also the movement of the toothbrush handle attached thereto, can be increased even beyond the normal maximum deflection. Note that use of the oppositely predisposed motion spring arch should be used in the presence of the footed edges of the motion spring or in the presence of some other means for creating a torque in the direction of desired deflection, because otherwise the motion spring will not deflect in the desired direction.

Figure 8:
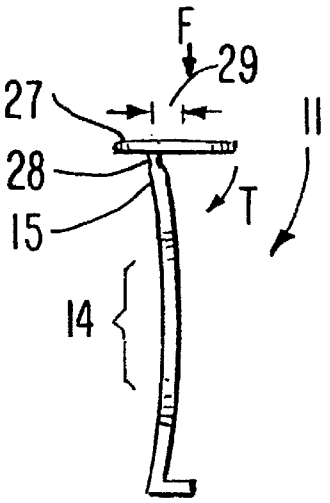
FIG. 8 Shows a left side elevational view of a most preferred embodiment of the device of the present invention in its relaxed position to be used with the rotatable toothbrush of U.S. Pat. Nos. 5,120,225 and 5,186,627.
Figure 9:
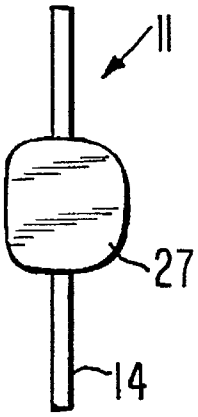
FIG. 9 shows top plan view of a most preferred embodiment of the device of the present invention in its relaxed position to be used with the rotatable toothbrush of U.S. Pat. Nos. 5,120,225 and 5,186,627.
Figure 10:
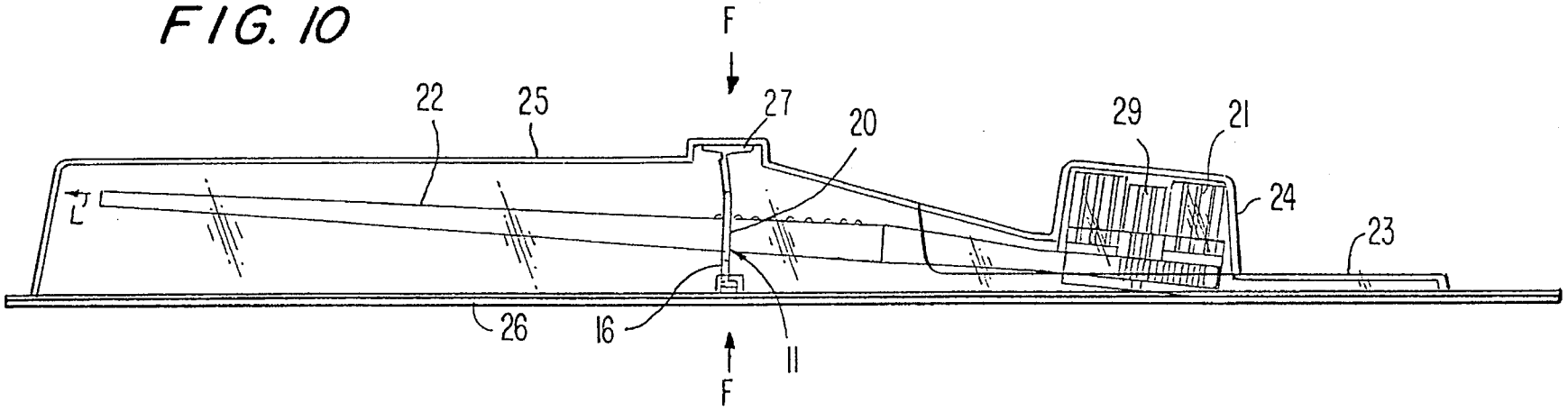
FIG. 10 shows a left side elevational view of a most preferred embodiment of the device of the present invention in its relaxed position in use with the rotatable toothbrush of U.S. Pat. Nos. 5,120,225 and 5,186,627.
Figure 11:
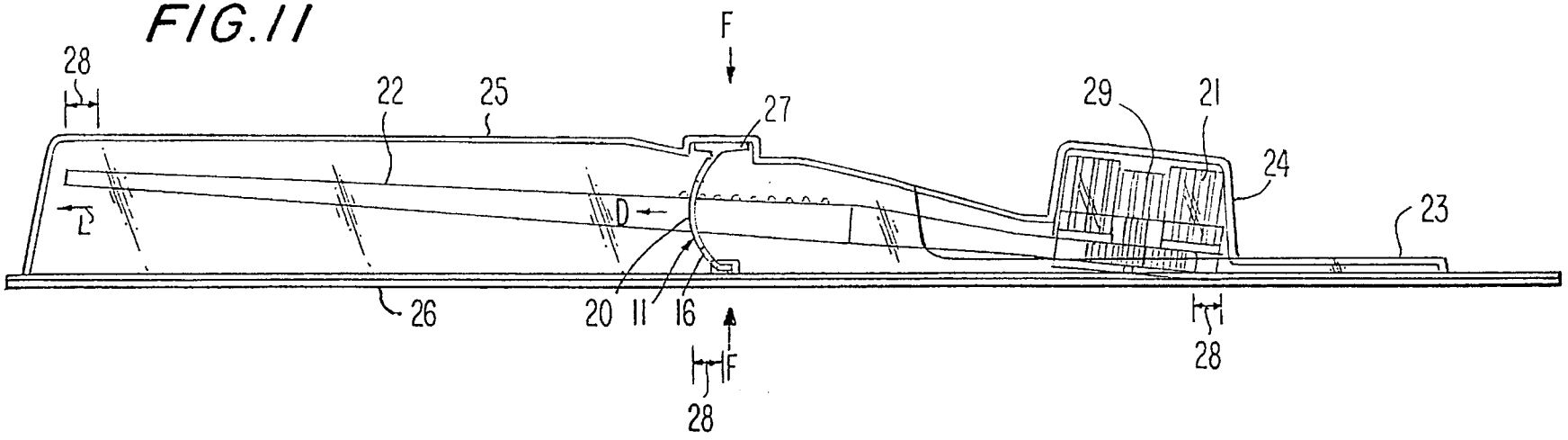
FIG. 11 shows a left side elevational view of a most preferred embodiment of the device of the present invention in its flexed position in use with the rotatable toothbrush of U.S. Pat. Nos. 5,120,225 and 5,186,627.

In a further preferred embodiment of this invention, the motion spring is equipped with a press button 27, as shown in FIGS. 8 and 9, instead of upper support strut 17. One function of the press button 27, as shown in FIG. 10, is to give a consumer a larger target on which to press when attempting to effect the rotation of the toothbrush bristles 29 of the packaged toothbrush. Referring to FIG. 11, a consumer presses the button 27 through the clear display package 25 in order to cause motion of the toothbrush bristles 29. In addition, the press button 27 serves the same function as does the widened foot 7 on the top edge 5 of the motion spring 1 shown in FIGS. 3 and 4, that is to form a greater area on the top edge 15 of the motion spring 11 to which a force F may be applied, thereby allowing the force F to be applied at a distance 29 from the plane of the motion spring 11 and creating a torque T about the top edge 15 of the motion spring 11 in the direction of desired deflection. In addition to creating a larger target for a consumer to press, the press button 27 thus actually helps to increase deflection in the desired direction.

Furthermore, in the preferred embodiment having the press button, shown in FIGS. 8–11, the material that forms the motion spring 11 is of reduced thickness in a region 28 at the top edge 15 just below the press button 28. This region of reduced thickness functions as an integral hinge 28 to enable the motion spring 11 to deform into an arched shape while the press button 27 remains horizontal. In the absence of the hinge region 28, the press button 27, which can be held in a horizontal position by the display packaging 25, may form a cantilever-type joint with the motion spring and may thus prevent the motion spring from achieving full deflection. When the hinge region 28 is present, the press button 27 forms a simple pin-support-type joint with the motion spring 11 and allows full deflection even when being held in a horizontal position. A hinge region is not necessary when only the widened feet 7,8, not a press button 27, are present at the edges of the motion spring, as shown in FIG. 7, because the widened feet 7,8 tend to rotate with the edges 15,16 of the motion spring 11 and thus do not prevent the motion spring from achieving full deflection.

Thus, a device and a method for effecting relative motion of component parts of a product within a closed sales display package are provided. One skilled in the art will appreciate that the present invention can be produced by other than the described embodiments, which are presented for purposes of illustration and not limitation, and the present invention is limited only by the claims that follow.

What is claimed is:

1. A device for effecting relative motion of movable components of a product within a closed sales display package, comprising:

a thin, planar, motion spring means having a top edge, a bottom edge and a middle portion;

means for securing said motion spring top edge to a first side of said sales display package;

means for securing said motion spring bottom edge to a second side of said sales display package opposite said first side; and means for securing said motion spring middle portion to, or for abutting said motion spring middle portion against, at least one movable component of said product;

whereby pressure applied vertically on said motion spring top edge through said first side of said sales display package will cause said motion spring means to deform such that said motion spring middle portion deflects in a desired horizontal direction perpendicular to the plane of said motion spring means, thereby moving said at least one movable component of said product in said desired horizontal deflection direction.

2. The device of claim 1 wherein said motion spring means is formed from a deformable and resilient material.

3. The device of claim 1 wherein said motion spring means has a height generally larger than a width, and has a thickness generally substantially smaller than both said height and said width.

4. The device of claim 1 wherein said motion spring means has an initial arched shape such that said motion spring middle portion has a slight initial deflection in the desired horizontal deflection direction.

5. The device of claim 1 wherein said motion spring means deforms into an arched shape when pressure is applied.

6. The device of claim 1 wherein said motion spring bottom edge is bent in a horizontal direction opposite to said desired horizontal deflection direction.

7. The device of claim 6 wherein said motion spring top edge is bent in a horizontal direction opposite to said desired horizontal deflection direction.

8. The device of claim 7 wherein said motion spring means has an initial arched shape such that motion spring middle portion has a slight initial deflection in the desired horizontal deflection direction.

9. The device of claim 7 wherein said motion spring means has an initial arched shape such that motion spring middle portion has a slight initial deflection in the direction opposite to the desired horizontal deflection direction.

10. A device for actuating the rotating bristles of a hand-actuated rotatable toothbrush within a closed sales display package, said toothbrush having a toothbrush head having a rotatable group of bristles mounted within the head and coupled to a movable toothbrush handle by way of a rack and pinion mechanism within the toothbrush head such that longitudinal reciprocation of the toothbrush handle causes said group of bristles in the toothbrush head to be rotated in response, said device comprising:

a thin, planar motion spring means having a top edge, a bottom edge and a middle portion;

means for securing said motion spring top edge to a first side of said sales display package;

means for securing said motion spring bottom edge to a second side of said sales display package opposite said first side; and means for securing said motion spring middle portion to, or for abutting said motion spring middle portion against, said toothbrush handle;

whereby pressure applied vertically on said motion spring top edge through said first side of said sales display package will cause said motion spring means to deform into an arched shape such that said motion spring middle portion deflects in a desired horizontal direction perpendicular to the plane of said motion spring means, thereby longitudinally moving said toothbrush handle secured thereto.

11. The device of claim 10 wherein said motion spring means is formed from a deformable and resilient material.

12. The device of claim 10 wherein said motion spring means has a height generally larger than a width, and has a thickness generally substantially smaller than both said height and said width.

13. The device of claim 10 wherein said motion spring means has an initial arched shape such that motion spring middle portion has a slight initial deflection in the desired horizontal deflection direction.

14. The device of claim 10 wherein said motion spring means deforms into an arched shape when pressure is applied.

15. The device of claim 10 wherein said motion spring bottom edge is bent in a horizontal direction opposite to said horizontal deflection direction.

16. The device of claim 15 wherein said motion spring top edge is bent in a horizontal direction opposite to said horizontal deflection direction.

17. The device of claim 16 wherein said motion spring means has an initial arched shape such that motion spring middle portion has a slight initial deflection in the desired horizontal deflection direction.

18. The device of claim 16 wherein said motion spring means has an initial arched shape such that motion spring middle portion has a slight initial deflection in the direction opposite to the desired horizontal deflection direction.

19. The device of claim 15 wherein said motion spring top edge further comprises an integrally formed, generally horizontal flat button means extending from said motion spring top edge at least in a horizontal direction opposite to said horizontal deflection direction, whereby pressure applied vertically on said motion spring top edge by pressing on said flat button through said first side of said sales display package.

20. The device of claim 19 wherein said motion spring means has an initial arched shape such that motion spring middle portion has a slight initial deflection in the desired horizontal deflection direction.

21. The device of claim 19 wherein said motion spring means has an initial arched shape such that motion spring middle portion has a slight initial deflection in the direction opposite to the desired horizontal deflection direction.

22. The device of claim 10 wherein said means for securing said motion spring middle portion to said toothbrush handle comprises a temporary adhesive.

23. The device of claim 10 wherein said toothbrush further comprises at least one ridge extending transversely across a top surface of said toothbrush handle and wherein:

said motion spring means further comprises a middle portion having an opening formed therethrough, said opening having at least a top downward-facing edge; and said means for securing said motion spring middle portion to said toothbrush handle comprises said at least one transverse ridge and said top downward-facing edge of said opening;

whereby said toothbrush handle is fit through said opening in said motion spring middle portion such that said top downward-facing edge of said opening abuts said at least one transverse ridge on said toothbrush handle and such that said motion spring means is secured to said toothbrush handle; and whereby, when said motion spring means deforms such that said motion spring middle portion deflects in a desired horizontal direction perpendicular to the plane of said motion spring means, said top edge of said opening in said motion spring middle portion abuts said at least one transverse ridge on said toothbrush handle and thereby longitudinally moves said toothbrush handle.

24. A method for effecting relative motion of movable components of a product within a closed sales display package, comprising the steps of:

forming a thin, planar, motion spring means having a top edge, a bottom edge and a middle portion;

securing said motion spring top edge to a first side of said sales display package;

securing said motion spring bottom edge to a second side of said sales display package opposite said first side;

securing said motion spring middle portion to, or for abutting said motion spring middle portion against, at least one movable component of said product; and applying pressure vertically on said motion spring top edge through said first side of said sales display package;

whereby said motion spring means is caused to deform such that said motion spring middle portion deflects in a desired horizontal direction perpendicular to the plane of said motion spring means, thereby moving said at least one movable component of said product in said desired horizontal deflection direction.

25. The method of claim 24 wherein said step of forming motion spring means comprises forming motion spring means from a deformable and resilient material.

26. The method of claim 24 wherein said step of forming motion spring means comprises forming motion spring means having a height generally larger than a width, and having a thickness generally substantially smaller than both said height and said width.

27. The method of claim 24 wherein said step of forming motion spring means comprises forming motion spring means having an initial arched shape such that said motion spring middle portion has a slight initial deflection in the desired horizontal deflection direction.

28. The method of claim 24 wherein said motion spring means deforms into an arched shape when pressure is applied.

29. The method of claim 24 wherein said step of forming motion spring means comprises forming motion spring means such that said motion spring bottom edge is bent in a horizontal direction opposite to said desired horizontal deflection direction.

30. The method of claim 29 wherein said step of forming motion spring means further comprises forming motion spring means such that motion spring top edge is bent in a horizontal direction opposite to said desired horizontal deflection direction.

31. The method of claim 30 wherein said step of forming motion spring means further comprises forming motion spring means having an initial arched shape such that motion spring middle portion has a slight initial deflection in the desired horizontal deflection direction.

32. The method of claim 30 wherein said step of forming motion spring means further comprises forming motion spring means having an initial arched shape such that motion spring middle portion has a slight initial deflection in the direction opposite to the desired horizontal deflection direction.

33. A method for actuating the rotating bristles of a hand-actuated rotatable toothbrush within a closed sales display package, said toothbrush having a toothbrush head having a rotatable group of bristles mounted within the head and coupled to a movable toothbrush handle by way of a rack and pinion mechanism within the toothbrush head such that longitudinal reciprocation of the toothbrush handle causes said group of bristles in the toothbrush head to be rotated in response, said method comprising the steps of:

forming a thin, planar motion spring means having a top edge, a bottom edge and a middle portion;

securing said motion spring top edge to a first side of said sales display package;

securing said motion spring bottom edge to a second side of said sales display package opposite said first side;

securing said motion spring middle portion to, or for abutting said motion spring middle portion against, said toothbrush handle; and applying pressure vertically on said motion spring top edge through said first side of said sales display package;

whereby said motion spring means is caused to deform such that said motion spring middle portion deflects in a desired horizontal direction perpendicular to the plane of said motion spring means, thereby moving said toothbrush handle secured thereto in a longitudinal direction.

34. The method of claim 33 wherein said step of forming motion spring means comprises forming motion spring means from a deformable and resilient material.

35. The method of claim 33 wherein said step of forming motion spring means comprises forming motion spring means having a height generally larger than a width, and having a thickness generally substantially smaller than both said height and said width.

36. The method of claim 33 wherein said step of forming motion spring means comprises forming motion spring means having an initial arched shape such that motion spring middle portion has a slight initial deflection in the desired horizontal deflection direction.

37. The method of claim 33 wherein said motion spring means deforms into an arched shape when pressure is applied.

38. The method of claim 33 wherein said step of forming motion spring means comprises forming motion spring means such that said motion spring bottom edge is bent in a horizontal direction opposite to said desired horizontal deflection direction.

39. The method of claim 38 wherein said step of forming motion spring means further comprises forming motion spring means such that said motion spring top edge is bent in a horizontal direction opposite to said horizontal deflection direction.

40. The method of claim 39 wherein said step of forming motion spring means further comprises forming motion spring means having an initial arched shape such that motion spring middle portion has a slight initial deflection in the desired horizontal deflection direction.

41. The method of claim 39 wherein said step of forming motion spring means further comprises forming motion spring means having an initial arched shape such that motion spring middle portion has a slight initial deflection in the direction opposite to the desired horizontal deflection direction.

42. The method of claim 38 wherein said step of forming motion spring means comprises forming motion spring means such that said motion spring top edge has an integrally formed, generally horizontal flat button means extending from said motion spring top edge at least in a horizontal direction opposite to said horizontal deflection direction, such that pressure is applied vertically on said motion spring top edge by pressing on said flat button through said first side of said sales display package.

43. The method of claim 42 wherein said step of forming motion spring means further comprises forming motion spring means having an initial arched shape such that motion spring middle portion has a slight initial deflection in the desired horizontal deflection direction.

44. The method of claim 42 wherein said step of forming motion spring means further comprises forming motion spring means having an initial arched shape such that motion spring middle portion has a slight initial deflection in the direction opposite to the desired horizontal deflection direction.

45. The method of claim 33 wherein said step of securing said motion spring middle portion to said toothbrush handle further comprises using a temporary adhesive.

46. The method of claim 33 wherein said toothbrush further comprises at least one ridge extending transversely across a top surface of said toothbrush handle and wherein:

said step of forming motion spring means further comprises forming motion spring means comprising a middle portion having an opening formed therethrough, said opening having at least a top downward-facing edge; and said step of securing said motion spring middle portion to said toothbrush handle further comprises using said at least one transverse ridge and said top downward-facing edge of said opening;

whereby said toothbrush handle is fit through said opening in said motion spring middle portion such that said top downward-facing edge of said opening abuts said at least one transverse ridge on said toothbrush handle and such that said motion spring means is secured to said toothbrush handle; and whereby, when said motion spring means deforms such that said motion spring middle portion deflects in a desired horizontal direction perpendicular to the plane of said motion spring means, said top edge of said opening in said motion spring middle portion abuts said at least one transverse ridge on said toothbrush handle and thereby longitudinally moves said toothbrush handle.

* * * * *